US009573732B2

(12) United States Patent
Bost et al.

(10) Patent No.: US 9,573,732 B2
(45) Date of Patent: Feb. 21, 2017

(54) CLOSURE FOR A PRODUCT RETAINING CONTAINER

(75) Inventors: Damon James Bost, Wake Forest, NC (US); James Edward Cooper, Jr., Bailey, NC (US); Lindsay Herman Davis, Raleigh, NC (US); Nisha Amol Keskar, Wake Forest, NC (US); Marco Josef Otto Kirch, Cary, NC (US); Darrell James Miller, Holly Springs, NC (US)

(73) Assignee: Nomacore LLC, Zebulon, NC (US)

( * ) Notice: Subject to any disclaimer, the term of this patent is extended or adjusted under 35 U.S.C. 154(b) by 0 days.

(21) Appl. No.: 13/012,670

(22) Filed: Jan. 24, 2011

(65) Prior Publication Data

US 2011/0180442 A1 Jul. 28, 2011

(30) Foreign Application Priority Data

Jan. 25, 2010 (EP) ..... 10000702

(51) Int. Cl.
*B65D 39/00* (2006.01)
*B65D 51/24* (2006.01)

(52) U.S. Cl.
CPC ..... *B65D 39/0011* (2013.01); *B65D 39/0058* (2013.01); *B65D 51/245* (2013.01); *B65D 2203/00* (2013.01); *B65D 2539/008* (2013.01)

(58) Field of Classification Search
USPC ..... 215/355
See application file for complete search history.

(56) References Cited

U.S. PATENT DOCUMENTS 3,208,617 A * 9/1965 Baron ..... 215/277
4,084,032 A * 4/1978 Pasersky ..... B41M 1/24 40/616
4,125,655 A * 11/1978 Kanzelberger ..... B32B 27/08 101/32
4,188,457 A * 2/1980 Throp ..... B29C 44/0407 215/261
5,447,246 A 9/1995 Finke
(Continued)

FOREIGN PATENT DOCUMENTS

CN 1463898 A 12/2003
CN 1527782 A 9/2004
(Continued)

OTHER PUBLICATIONS

International Preliminary Report on Patentability for PCT/EP2011/050896, mailed Jan. 17, 2013, 7 pages.
(Continued)

*Primary Examiner* — Shin Kim
(74) *Attorney, Agent, or Firm* — Withrow & Terranova, P.L.L.C.

(57) ABSTRACT

A closure for a product retaining container constructed for being inserted and securely retained in a portal forming neck of the container has a substantially cylindrical shape and substantially flat terminating surfaces forming the opposed ends of said closure, wherein at least one of said terminating surfaces is at least partially covered by a decorative layer. Indicia may be applied on at least one of the two substantially flat terminating surfaces forming the opposed ends of a closure by means of hot stamping.

37 Claims, 2 Drawing Sheets

(56) References Cited

U.S. PATENT DOCUMENTS 5,480,915 A * 1/1996 Burns ..... B65D 39/00 215/355
5,692,629 A * 12/1997 Burns ..... B65D 39/00 101/2
5,904,965 A * 5/1999 Noel ..... B32B 5/32 215/355
6,085,923 A * 7/2000 Yaniger ..... B29C 47/0016 215/355
6,153,275 A * 11/2000 Yaniger ..... B29C 47/0016 215/355
6,221,451 B1 * 4/2001 Lauer ..... B32B 5/18 215/355
6,355,320 B1 * 3/2002 Allman ..... B29C 47/126 215/355
6,528,152 B1 * 3/2003 Piriwe ..... B65D 39/00 215/230
6,613,406 B1 * 9/2003 Yaniger ..... 428/34.4
6,662,490 B1 * 12/2003 Aesch, Jr. ..... A01M 1/24 43/124
7,314,661 B2 * 1/2008 Hueto ..... B65D 39/0058 215/355
7,898,422 B2 * 3/2011 Puccini ..... B65D 39/0058 340/572.1
2002/0014468 A1 * 2/2002 Stroppiana ..... 215/355
2003/0102283 A1 6/2003 Fox
2003/0157313 A1 * 8/2003 Shibuya et al. ..... 428/314.4
2004/0178168 A1 * 9/2004 Matheson ..... 215/364
2005/0233109 A1 10/2005 Hettinga
2006/0006132 A1 * 1/2006 Lauer et al. ..... 215/355
2006/0124232 A1 * 6/2006 Mebberson ..... B67B 1/03 156/256

FOREIGN PATENT DOCUMENTS

CN 1723158 A 1/2006
WO 03/004367 A1 1/2003
WO 2004/060763 A1 7/2004
WO 2004060763 A1 7/2004
WO 2009063095 A2 5/2009

OTHER PUBLICATIONS

Canadian Office Action for Application No. 2,788,035 mailed Apr. 17, 2014, 2 pages.
Chinese Office Action for Application No. 201180011502.9 mailed Jun. 25, 2014, 9 pages (No Translation).
International Search Report and Written Opinion for PCT/EP2011/050896 mailed Apr. 5, 2011, 11 pages.

* cited by examiner

CLOSURE FOR A PRODUCT RETAINING CONTAINER

RELATED APPLICATIONS

The present application claims priority to European Patent Application No. 10000702.0 filed on Jan. 25, 2010, entitled "CLOSURE FOR A PRODUCT RETAINING CONTAINER," which is incorporated herein by reference in its entirety.

BACKGROUND

Technical Field

This invention relates to closures or stoppers for containers containing liquids, low viscosity substrates, and small solids, and more particularly, to closures or stoppers having a substantially cylindrical shape and comprising substantially flat terminating surfaces forming the opposed ends of said closure and employable as a stopper for a container.

More particularly, this invention relates to closures and stoppers comprising decorative indicia such as letters, symbols, colors, graphics, and wood tones printed on at least one of the substantially flat terminating surfaces forming the opposed ends of said closure or stopper.

Furthermore, this invention relates to a method of applying indicia on at least one of the two substantially flat terminating surfaces forming the opposed ends of a closure for a product retaining container, said closure having a substantially cylindrical shape and being constructed for being inserted and securely retained in a portal forming neck of the container.

Background Art

In view of the wide variety of products that are sold for being dispensed from containers, particularly containers with round necks which define the dispensing portal, numerous constructions have evolved for container stoppers or closure means for the portals. Generally, products such as vinegar, vegetable oils, laboratory liquids, detergents, honey, condiments, spices, alcoholic beverages, and the like, impose similar requirements on the type and construction of the closure means used for containers for these products. However, wine sold in bottles represents the most demanding product for bottle closure means, due to the numerous and burdensome requirements placed upon the closure means used for wine bottles. In view of these demands, most wine bottle closures or stoppers have been produced from a natural material known as "cork".

While natural cork still remains the dominant material for wine closures, synthetic wine closures have become increasingly popular over the last years, largely due to the problem of wine spoilage as a result of "cork taint", a phenomenon that is almost exclusively associated with natural cork materials. Known synthetic closures generally comprise a foamed plastic material having a closed cell structure and are made, for example, by extrusion, in particular co-extrusion, or injection molding. Wine closures made from natural cork or synthetic materials are the preferred bottle closure for wine storage, particularly for medium and high quality wines where tradition, the wine mystique and the bottle opening ritual with a corkscrew, are a very important, though intangible, aspect of the wine consumption.

Closures for wine bottles must satisfy very stringent requirements. In particular, one of the principal difficulties to which any bottle closure is subjected in the wine industry is the manner in which the closure is inserted into the bottle. Typically, the closure is placed in a jaw clamping member positioned above the bottle portal. The clamping member incorporates a plurality of separate and independent jaw members which peripherally surround the closure member and are movable relative to each other to compress the closure member to a diameter substantially less than its original diameter. Once the closure member has been fully compressed, a plunger moves the closure means from the jaws directly into the neck of the bottle, where the closure member is capable of expanding into engagement with the interior diameter of the bottle neck and portal, thereby sealing the bottle and the contents thereof.

In view of the fact that the jaw members must be independent of each other and separately movable in order to enable the closure member to be compressed to the substantially reduced diameter, each jaw member comprises a sharp edge which is brought into direct engagement with the closure member when the closure member is fully compressed. Depending upon the composition of the closure member, score lines are frequently formed on the outer surface of the closure member, which prevents a complete, leak-free seal from being created when the closure member expands into engagement with the bottle neck.

Thus, any synthetic bottle closure must be able to withstand this conventional bottling and sealing method. Furthermore, many cork sealing members also incur damage during the bottling process, resulting in leakage or tainted wine.

Another problem inherent in the wine industry is the requirement that the wine stopper must be capable of withstanding a substantial pressure build up that occurs during the storage of the wine product after it has been bottled and sealed. Due to natural expansion of the wine during hotter months, pressure builds up, imposing a burden upon the bottle stopper that must be resisted without allowing the stopper to be displaced from the bottle. As a result, the bottle stopper employed for wine products must be capable of secure, intimate, frictional engagement with the bottle neck in order to resist any such pressure build up.

A further problem inherent in the wine industry is the requirement that secure, sealed engagement of the stopper with the neck of the bottle must be achieved virtually immediately after the stopper is inserted into the neck of the bottle. During normal wine processing, the stopper is compressed, as detailed above, and inserted into the neck of the bottle to enable the stopper to expand in place and seal the bottle. However, such expansion must occur immediately upon insertion into the bottle since many processors tip the bottle onto its side or neck down after the stopper is inserted into the bottle neck, allowing the bottle to remain stored in this position for extended periods of time. If the stopper is unable to rapidly expand into secure, intimate, frictional contact and engagement with the walls of the neck of the bottle, wine leakage will occur.

A further requirement imposed upon closures or stoppers for wine bottles is the requirement that the closure be removable from the bottle using a reasonable extraction force. Although actual extraction forces extend over a wide range, the generally accepted, conventional extraction force is typically below 100 pounds.

In achieving a commercially viable stopper or closure, a careful balance must be made between secure sealing and providing a reasonable extraction force for removal of the closure from the bottle. Since the requirements for these two characteristics are in direct opposition to each other, a careful balance must be achieved so that the stopper or closure is capable of securely sealing the wine in the bottle, preventing both leakage and gas transmission, while also being removable from the bottle without requiring an excessive extraction force.

Another requirement for commercially viable wine stoppers or closures is a low oxygen permeability. Too much oxygen can cause the premature spoilage of wine. In fact, oxidation occurs over a period of time to render the beverage undrinkable. Thus, it is necessary to effectively prevent oxygen from entering the bottle in order to extend and preserve the freshness and shelf life of the product. Any commercially viable wine stopper or closure should therefore have a low oxygen transfer rate (OTR). It was found that the oxygen transfer rate is closely associated with the homogeneity of the cell structure of the closure and the outer surface of the substantially flat terminating surfaces forming the opposed ends of said closure.

Finally, it is desirable to provide decorative indicia such as letters and ornaments on the surface of wine stoppers (e.g. the crest or emblem of a winery). Natural corks are generally marked by a method commonly referred to as "fire branding", i.e. by the application of a hot branding tool. Alternatively, natural corks may also be branded by application of colors or dyes. Due to food safety concerns, marking of natural corks with colors or dyes is generally only effected on the curved cylindrical surface of the cork that is not in direct contact with the wine. On the other hand, marking on the flat terminating surfaces of natural corks is generally effected by means of fire branding only since this method does not impose any food safety concerns.

It is also known to brand synthetic closures. Synthetic closures are commonly branded by means of inkjet printing using special dyes or colors approved for indirect food contact. Since such colors and dyes are normally not approved for direct food contact marking of synthetic closures with colors or dyes is generally only effected on the curved cylindrical surface of the cork that is not in direct contact with the wine. Therefore, marking on the flat terminating surfaces of synthetic closures is generally only known for injection molded closures, where marking is affected during the molding process of the closure by providing raised portions on the flat terminating surfaces.

In contrast thereto, there is currently no method available for marking the flat terminating surface of synthetic closures that have been manufactured by means of extrusion, in particular by co-extrusion. Although laser marking may, in theory, be a feasible method since it allows the avoidance of direct food contact, this method is inherently slow and expensive since it requires the use of special laser dye additives. Also, there have been concerns that laser marking of the flat terminating surfaces of synthetic closures may adversely change the foam structure of the core element, which may, in consequence, adversely affect the sensitive gas permeation properties of such closures.

Therefore, the present disclosure provides a method of applying indicia on at least one of the two substantially flat terminating surfaces forming the opposed ends of a closure for a product retaining container that does not give rise to any food safety concerns, is economically feasible, and/or does not have a significant effect on gas permeation or mechanical properties of the closure.

SUMMARY OF THE DETAILED DESCRIPTION

The present disclosure provides for a method of applying indicia on at least one of the two substantially flat terminating surfaces forming the opposed ends of a closure for a product retaining container, said closure having a substantially cylindrical shape and being constructed for being inserted and securely retained in a portal forming neck of the container, wherein said method comprises the following steps:

A. providing a stamping foil comprising at least a carrier film and a decorative layer;

B. providing a stamping tool that is patterned so as to form a negative image of said indicia by raised regions on the surface of the stamping tool;

C. placing said stamping foil on top of or slightly above said terminating surface of said closure with said decorative layer facing towards said flat terminating surface, whereby said flat terminating surface is at least partially covered by the stamping foil;

D. pressing said stamping foil against said terminating surface of said closure by means of said stamping tool under application of heat and/or pressure, whereby those portions of said decorative layer that have been in contact with the raised regions of said stamping tool are being transferred from the stamping foil and permanently affixed to said terminating surface of said closure, thereby forming the desired indicia on the terminating surface of said closure; and E. removing the used stamping foil, thereby uncovering the indicia formed on the terminating surface of said closure.

In another aspect, the present disclosure provides for a closure for a product retaining container constructed for being inserted and securely retained in a portal forming neck of the container is provided, said closure having a substantially cylindrical shape and comprising substantially flat terminating surfaces forming the opposed ends of said closure, wherein at least one of said terminating surfaces is at least partially covered by a decorative layer.

With the present disclosure it is possible to conveniently brand the substantially flat terminating surface of closures, in particular of synthetic closures.

In fact, the application of a decorative layer, in particular of a decorative plastic layer, by means of heat and/or pressure transfer allows for permanent branding of synthetic closures without giving rise to concerns relating to food safety. Also, the application of said decorative layer by means of heat and/or pressure transfer does not negatively impact the gas permeation and/or mechanical properties of synthetic closures, in particular of co-extruded synthetic closures.

The present disclosure can be employed on any desired product, whether the product is a liquid, a viscous material, or a solid distributed in a bottle or container and dispensed through the open portal of the container neck.

As will become evident from the following detailed disclosure, the synthetic closure of the present disclosure may be employed as a bottle closure or stopper for any desired product. However, for the reasons detailed above, wine products impose the most burdensome standards and requirements on a bottle closure. Consequently, in order to clearly demonstrate the universal applicability of the synthetic closure of the present disclosure, the following disclosure focuses on the applicability and usability of the synthetic closure of the present disclosure as a closure or stopper for wine containing bottles. However, this discussion is for exemplary purposes only and is not intended as a limitation of the present disclosure.

As discussed above, a bottle closure or stopper for wine must be capable of performing numerous separate and distinct functions. One principal function is the ability to withstand the pressure build up due to temperature variations during storage, as well as prevent any seepage or leakage of the wine from the bottle. Furthermore, a tight seal must also be established to prevent unwanted gas exchange between ambient conditions and the bottle interior, so as to prevent any unwanted oxidation or permeation of gases from the wine to the atmosphere. In addition, the unique corking procedures employed in the wine industry also impart substantial restrictions on the bottle closure, requiring a bottle closure which is highly compressible, has high immediate compression recovery capabilities and can resist any deleterious effects caused by the clamping jaws of the bottle closure equipment.

According to an exemplary embodiment of the disclosure the synthetic bottle closure of the present disclosure comprises, as its principal component, a core member which is formed from extruded, foamed, plastic polymers, copolymers, or homopolymers. Although any known foamable plastic material can be employed in the extrusion process for developing the bottle closure of the present disclosure, the plastic material must be selected for producing physical properties similar to natural cork, so as to be capable of providing a synthetic closure for replacing natural cork as a closure for wine bottles. The plastic material for the core member may be a closed cell plastic material. Suitable plastic materials for the core member are, for example, polyethylenes, metallocene catalyst polyethylenes, polybutanes, polybutylenes, polyurethanes, silicones, vinyl-based resins, thermoplastic elastomers, polyesters, olefin block copolymers, ethylenic acrylic copolymers, ethylene-vinyl-acetate copolymers, ethylene-methyl-acrylate copolymers, ethylene-butyl-acrylate copolymers, ethylene-propylene-rubber, styrene butadiene rubber, styrene butadiene block copolymers, ethylene-ethyl-acrylic copolymers, ionomers, polypropylenes, and copolymers of polypropylene, copolymerizable ethylenically unsaturated commoners and/or mixtures thereof. An exemplary plastic material for the core element is polyethylene, in particular LDPE, and/or ethylene-vinyl-acetate copolymer (EVA). The density of the core member in the final product may be between about 100 to about 500 kg/m$^3$, in particular between about 200 to about 350 kg/m$^3$ or between about 250 to about 420 kg/m$^3$. In another embodiment, the density of the core member in the final product may be between about 100 to about 600 kg/m$^3$, in particular between about 150 to about 500 kg/m$^3$ or between about 200 to about 400 kg/m$^3$. In the final product, the cell size of the core member may be substantially homogeneous throughout its entire length and diameter. Furthermore, certain embodiments of the present disclosure may include pieces of natural cork that are agglomerated by an adhesive or embedded in a plastic material.

Depending upon the sealing process employed for inserting the synthetic closure of the present disclosure in a desired bottle, additives, such as slip additives, may be incorporated into the outer, peripherally surrounding layer of the synthetic closure of the present disclosure to provide lubrication of the synthetic closure during the insertion process. In addition, other additives typically employed in the bottling industry may also be incorporated into the synthetic closure of the present disclosure for improving the sealing engagement of the synthetic closure with the bottle as well as reducing the extraction forces necessary to remove the synthetic closure from the bottle for opening the bottle.

According to one embodiment of the present disclosure, a unique synthetic bottle closure is realized by forming an outer layer peripherally surrounding the core member in intimate, bonded, interengagement therewith. The outer, peripheral layer of the synthetic closure is formed from foam or non-foam plastic material. However, the outer peripherally surrounding layer is formed with a substantially greater density in order to impart desired physical characteristics to the synthetic bottle closure of the present disclosure. The peripheral layer is formed from one or more of the following plastic materials: thermoplastic polyurethanes, thermoplastic olefins, thermoplastic vulcanizates, flexible polyolefins, olefin block copolymers, fluoroelastomers, fluoropolymers, polyethylenes, styrene butadiene block copolymers, styrene block copolymers, thermoplastic elastomers, polyether-type polyurethanes and/or mixtures or blends thereof. An exemplary plastic material for the peripheral layer is polypropylene, EPDM, and/or polystyrene. If desired, the peripheral layer can be formed from a transparent plastic material. The plastic material selected for the peripheral layer may be different from that of the core member. Furthermore, the density of the peripheral layer in the final product is preferably about 300 to about 1500 kg/m$^3$, in particular about 505 to about 1250 kg/m$^3$, and most preferred about 750 to about 1100 kg/m$^3$.

In accordance with an exemplary embodiment of the present disclosure, a continuous manufacturing operation is provided wherein the core member of the synthetic closure is formed by a continuous extrusion process which enables the core to be manufactured as an elongated, continuous length of material.

Furthermore, in accordance with the present disclosure, an outer layer or skin surface can be formed about the central core. In this way, the elongated length of material is produced in a continuous production operation enabling all production steps to be completed prior to the formation of the individual synthetic closure members by cutting the elongated length of extruded material in the desired manner.

By achieving a synthetic closure in accordance with the present disclosure, a bottle closure is realized which is capable of satisfying all requirements imposed thereon by the wine industry, as well as any other bottle closure/packaging industry. As a result, a synthetic bottle closure is attained that can be employed for completely sealing and closing a desired bottle for securely and safely storing the product retained therein, with desired markings and/or indicia printed thereon.

The invention accordingly comprises an article of manufacture possessing the features, properties, and relation of elements which will be exemplified in the article hereinafter described, and the scope of the invention will be indicated in the claims.

BRIEF DESCRIPTION OF THE FIGURES

For a fuller understanding of the nature and objects of the invention herein described, reference should be had to the following detailed description taken in connection with the accompanying drawings, in which.

DETAILED DESCRIPTION OF THE PREFERRED EMBODIMENTS

By referring to FIGS. 1 to 4, along with the following detailed disclosure, the construction and production method for the closures of the present disclosure can best be understood. In these Figures, as well as in the following detailed disclosure, the synthetic closure of the present disclosure, and its method of production, is depicted and discussed as a bottle closure for wine products. However, as detailed above, the present disclosure is applicable as a synthetic closure for use in sealing and retaining any desired product in any desired closure system. However, due to the stringent and difficult demands and requirements placed upon closures for wine products, the following detailed disclosure focuses upon the applicability of the synthetic bottle closures of the present disclosure as a closure for wine bottles. However, it is to be understood that this detailed discussion is provided merely for exemplary purposes and is not intended to limit the present disclosure to this particular application and embodiment.

Figure 1:
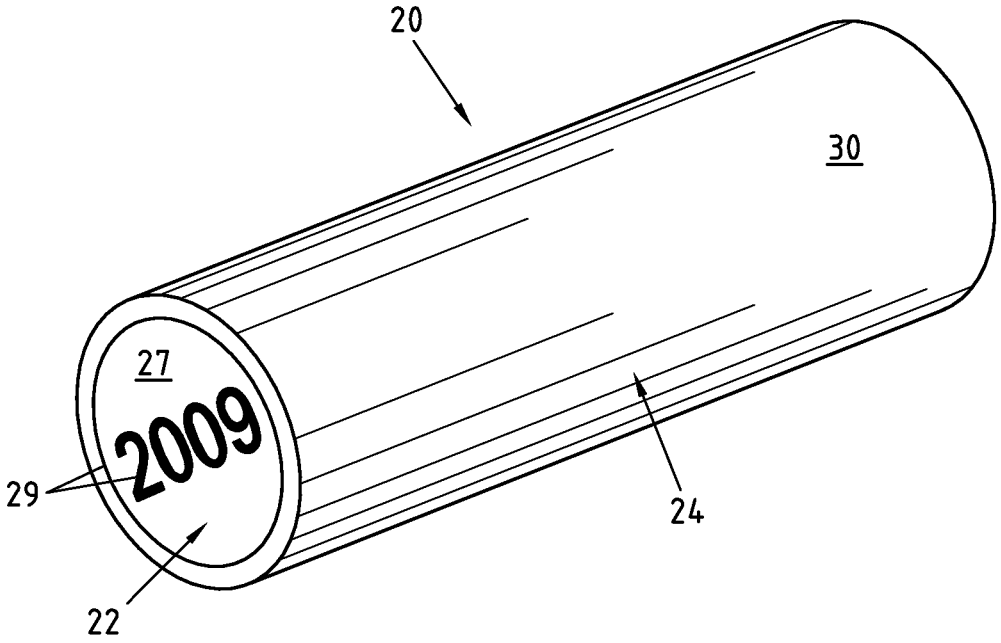
FIG. 1 is a perspective view of a synthetic closure according to an embodiment of the present disclosure.
Figure 2:
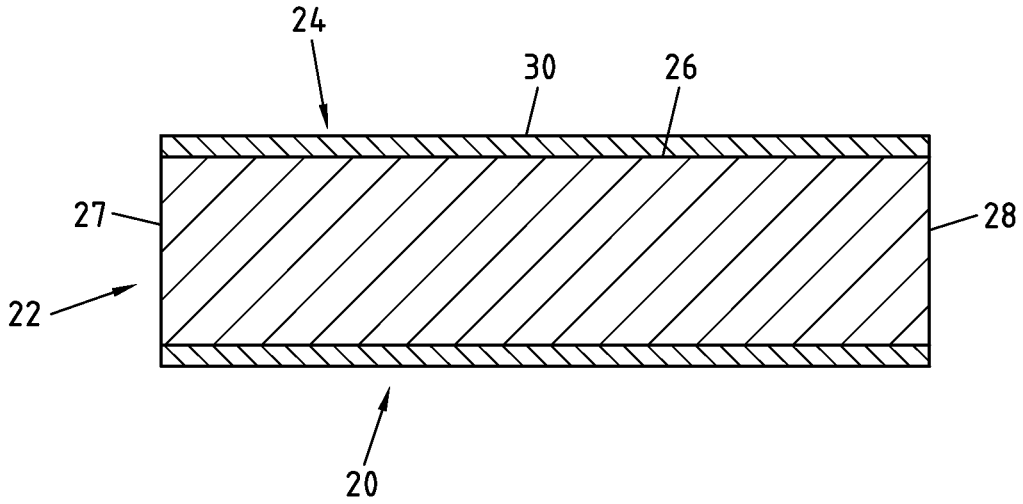
FIG. 2 is a cross sectional-side elevation of a synthetic closure according to an embodiment of the present disclosure.

In FIG. 1, an exemplary construction of a synthetic closure 20 is depicted comprising a generally cylindrical shape formed by core member 22 and outer layer or skin layer 24 which peripherally surrounds and is intimately bonded to core member 22. In an exemplary embodiment, core member 22 comprises a substantially cylindrically shaped surface 26, terminating with substantially flat end surfaces 27 and 28. Parts of the substantially flat end surface 27 are covered by a decorative layer 29 forming the number "2009" and a circle. It should be appreciated that the closures of the present disclosure are not restricted to such layered products. It should be noted, however, that the synthetic closure of the present disclosure may also comprise only one single component (e.g. a foamed, partially foamed or unfoamed cylindrically shaped body made from thermoplastic material) without any additional layers. Whenever applicable, the following detailed description of a synthetic closure having a layered structure (i.e. a core member and at least one outer layer) shall also apply to such single component synthetic closures.

In an exemplary embodiment, outer layer or skin layer 24 is intimately bonded directly to core member 22, peripherally surrounding and enveloping surface 26 of core member 22. Outer layer or skin layer 24 incorporates exposed surface 29, which comprises a substantially cylindrical shape and forms the outer surface of synthetic bottle closure 20 of the present disclosure, along with flat end of surfaces 27 and 28.

In order to assist in assuring entry of synthetic bottle closure 20 into the portal of the bottle into which closure 20 is inserted, the terminating edge of peripheral layer 24 may be beveled or chamfered (not depicted). Similarly, the terminating edge of peripheral layer 24 also may comprise a similar bevel or chamfer (not depicted). Although any desired bevel or chamfered configuration can be employed, such as a radius, curve, or flat surface, it has been found that merely cutting the ends with an angle of about 45, the desired reduced diameter area is provided for achieving the desired effect.

By incorporating chamfered or beveled ends on synthetic bottle closure 20, automatic self-centering is attained. As a result, when synthetic bottle closure 20 is compressed and ejected from the compression jaws into the open bottle for forming the closure thereof, synthetic bottle closure 20 is automatically guided into the bottle opening, even if the clamping jaws are slightly misaligned with the portal of the bottle. By employing this configuration, unwanted difficulties in inserting bottle closure 20 into any desired bottle are obviated. However, in applications which employ alternate stopper insertion techniques, chamfering of ends may not be needed. Further, in order to facilitate the insertion of the closure into the bottle neck, the outer surface can fully or partly be coated with suitable lubricants, in particular with silicones.

In order to produce the attributes required for use in the wine industry, core 22 is formed from foam plastic material using a continuous extrusion process. Although other prior art systems have employed molded foamed plastic material, these processes have proven to be more costly and incapable of providing a final product with the attributes of the present disclosure.

In an exemplary embodiment, core member 22 is formed as an extruded, medium or low density closed cell foamed plastic comprising one or more plastics selected from the group consisting of inert polymers, homopolymers, and copolymers.

The thermoplastic polymer may be selected from the group consisting of polyethylenes, metallocene catalyst polyethylenes, polybutanes, polybutylenes, polyurethanes, silicones, vinyl based resins, thermoplastic elastomer, polyesters, ethylene acrylic copolymers, ethylene-vinyl-acetate copolymers, ethylene-methyl acrylate copolymers, ethylene-butyl-acrylate copolymers, ethylene-propylene-rubber, styrene butadiene rubber, styrene butadiene block copolymers, styrene block copolymers, ethylene-ethyl-acrylic copolymers, ionomers, polypropylenes, and copolymers of polypropylene and copolymerizable ethylenically unsaturated commoners, as well as ethylenic acrylic copolymers, ethylene-vinyl-acetate copolymers, ethylene-methyl-acrylate copolymers, thermoplastic polyurethanes, thermoplastic olefins, olefin block copolymers, thermoplastic vulcanizates, flexible polyolefins, fluoroelastomers, fluoropolymers, polyethylenes, teflons (polytetrafluoroethylenes), ethylene-butyl-acrylate copolymers, ethylene-propylene-rubber, ethylene-ethyl-acrylic copolymers and blends thereof. Furthermore, if a polyethylene is employed, it has been found that the polyethylene may comprise one or more polyethylenes selected from the group consisting of high density, medium density, low density, linear low density, ultra high density, and medium low density.

More particularly, the thermoplastic polymer may be selected from the group consisting of polyethylenes, metallocene catalyst polyethylenes, polybutanes, polybutylenes, polyurethanes, silicones, vinyl/based resins, thermoplastic elastomers, polyesters, ethylenic acrylic copolymers, ethylene-vinyl-acetate copolymers, ethylene-methyl-acrylate copolymers, thermoplastic polyurethanes, thermoplastic olefins, thermoplastic vulcanizates, flexible polyolefins, fluoroelastomers, fluoropolymers, polyethylenes, polytetrafluoroethylenes, and blends thereof, ethylene-butyl-acrylate copolymers, ethylene-propylene-rubber, styrene butadiene rubber, styrene butadiene block copolymers, styrene block copolymers, ethylene-ethyl-acrylic copolymers, ionomers, polypropylenes, and copolymers, ionomers, polypropylenes, and copolymers of polypropylene and copolymerizable ethylenically unsaturated comonomers, olefin block polymers, and mixtures thereof.

Regardless of the foamable plastic material selected for forming core member 22, the resulting extruded foam product may have a density ranging between about 100 $kg/m^3$ to 500 $kg/m^3$. Although this density range has been found to provide an effective core member, the density of the extruded foam core member 20 preferably ranges between about 200 $kg/m^3$ to 350 $kg/m^3$. In another embodiment, the resulting extruded foam product may have a density ranging between about 100 kg/m$^3$ to 600 kg/m$^3$. Although this density range has been found to provide an effective core member, the density of the extruded foam core member 20 preferably ranges between about 200 kg/m$^3$ to 400 kg/m$^3$.

Since core member 22 is substantially closed cell in structure, additives can intermixed with the plastic material to form a closed cell foam. The resulting core member 22 of the present disclosure may have average cell sizes ranging from between about 0.02 millimeters to 0.50 millimeters and/or a cell density ranging between about 25,000,000 cells/cm$^3$ to 8,000 cells/cm$^3$. Although this cell configuration has been found to produce a highly effective product, it has been found that the most desirable product possesses an average cell size ranging between about 0.05 and 0.1 millimeters with a cell density ranging between about 8,000,000 cells/cm$^3$ to 1,000,000 cells/cm$^3$. In another embodiment, an average cell size ranges between about 0.05 and 0.3 millimeters. Furthermore, in order to assure that core member 22 possesses inherent consistency, stability, functionality and capability of providing long-term performance, the cell size of core member 22 may be homogeneous throughout its entire length and diameter. According to an exemplary embodiment of the disclosure, the foam has a cell size characterized by a range of between about 0.025 mm minimum and about 0.5 mm maximum, in particular between about 0.05 mm minimum to about 0.35 mm maximum.

In order to control the cell size of core member 22 and attain the desired cell size detailed above, a nucleating agent can be employed. It has been found that by employing a nucleating agent selected from the group consisting of calcium silicate, talc, clay, titanium oxide, silica, barium sulfate, diatomaceous earth, and mixtures of citric acid and sodium bicarbonate, the desired cell density and cell size is achieved.

In this regard, it has been found that cell size and cell density is most advantageously realized in the formation of core member 22 by employing between about 0.1 and 10 parts by weight of the nucleating agent for every 100 parts by weight of the plastic foam. In this way, the desired physical characteristics of core member 22 are realized along with the desired control of the cell size and cell density. This leads to product consistency currently not available with natural materials.

As is well known in the industry, a blowing agent can be employed in forming extruded foam plastic material. In the present disclosure, a variety of blowing agents can be employed during the extruded foaming process whereby core member 22 is produced. Typically, either physical blowing agents or chemical blowing agents are employed. Suitable blowing agents that have been found to be efficacious in producing the core member of the present disclosure comprise one or more selected from the group consisting of: aliphatic hydrocarbons having 1-9 carbon atoms, halogenated aliphatic hydrocarbons having 1-9 carbon atoms and aliphatic alcohols having 1-3 carbon atoms. Aliphatic hydrocarbons include methane, ethane, propane, n-butane, isobutane, n-pentane, isopentane, neopentane, and the like. Among halogenated hydrocarbons and fluorinated hydrocarbons they include, for example, methylfluoride, perfluoromethane, ethyl fluoride, 1,1-difluoroethane (HFC-152a), 1,1,1-trifluoroethane (HFC-430a), 1,1,1,2-tetrafluoroethane (HFC-134a), pentafluoroethane, perfluoroethane, 2,2-difluoropropane, 1,1,1-trifluoropropane, perfluoropropane, perfluorobutane, perfluorocyclobutane. Partially hydrogenated chlorocarbon and chlorofluorocarbons for use in this disclosure include methyl chloride, methylene chloride, ethyl chloride, 1,1,1-trichlorethane, 1,1-dichloro1-fluoroethane (HCFC-141b), 1-chloro1,1-difluoroethane (HCFC-142b), 1,1-dichloro-2,2,2-trifluoroethane (HCFC-123) and 1-chloro-1,2,2,2-tetrafluoroethane (HCFC-124). Fully halogenated chlorofluorocarbons include trichloromonofluoromenthane (CFC11), dichlorodifluoromenthane (CFC-12), trichlorotrifluoroethane (CFC-113), dichlorotetrafluoroethane (CFC-114), chloroheptafluoropropane, and dichlorohexafluoropropane. Fully halogenated chlorofluorocarbons are not preferred due to their ozone depiction potential. Aliphatic alcohols include methanol, ethanol, n-propanol and isopropanol. Suitable inorganic blowing agents useful in making the foam of the present disclosure include carbon dioxide, nitrogen, carbon, water, air, nitrogen, helium, and argon.

Chemical blowing agents include azodicarbonamide, azodiisobutyro-nitride, benzenesulfonhydrazide, 4,4-oxybenzene sulfonylsemicarbazide, p-toluene sulfonylsemicarbazide, barium azodicarboxlyate, N,N'-Dimethyl-N,N'-dinitrosoterephthalamide, trihydrazinotriazine, and hydrocerol.

To produce the desired product, the blowing agent is incorporated into the plastic melt in a quantity ranging between about 0.005% to 10% by weight of the weight of the plastic material.

As detailed above, either a physical blowing agent or a chemical blowing agent can be employed as part of the manufacturing process for forming core member 22 of the present disclosure. However, it has been found that the selection of a physical blowing agent is appropriate since physical blowing agents allow core member 22 of synthetic bottle closure 20 to be achieved with a lower density, which is closer to natural cork.

In this regard, a blowing agent which is inert is particularly contemplated. Although any desired inert blowing agent may be employed, the blowing agent may be selected from the group consisting of nitrogen, carbon dioxide, sulphur dioxide, water, air, nitrogen, helium, and argon. In addition, hydrocarbons can be employed as the blowing agent which may be selected from the group consisting of butane, isobutene, pentane, isopentane and propane.

In addition to attaining core member 22 which possesses a construction with physical characteristics similar to nature cork, the synthetic bottle closure 20 of the present disclosure can also comprise a peripheral layer 24. The peripheral layer 24 is of particular importance in attaining synthetic bottle closure 20 which is capable of meeting and exceeding all of the difficult requirements imposed upon a closure or stopper for the wine industry.

As discussed above, the wine industry incorporates corking machines which incorporate a plurality of cooperating, movable jaws which move simultaneously to compress the bottle stopper to a diameter substantially smaller than the diameter of the portal into which the stopper is inserted. Then, once fully compressed, the stopper is forced out of the jaws directly into the bottle, for expanding and immediately closing and sealing the bottle.

Due to the operation of the cooperating jaws which are employed to compress the stopper for insertion into the bottle, sharp edges of the jaw members are forced into intimate contact with the outer surface of the stopper. Although cork material has been successful in resisting permanent damage from the jaw edges in most instances, other prior art synthetic stoppers have been incapable of resisting these cutting forces. As a result, longitudinal cuts, score lines or slits are formed in the outer surface of the stopper, enabling liquid to seep from the interior to the exterior of the bottle.

This inherent problem, existing with prior art cork and synthetic closures, can be eliminated by incorporating peripheral layer 24 which surrounds and envelopes substantially the entire outer surface 26 of core member 22. In addition, by forming peripheral layer 24 from high density, rugged, score-resistant material, synthetic bottle closure 20 overcomes all of the prior art difficulties and achieves a bottle closure having physical properties equal to or superior to conventional cork material.

In an exemplary embodiment, peripheral layer 24 is formed from plastic material identical or similar to the plastic material employed for core member 22. However, as detailed below, the physical characteristics imparted to peripheral layer 24 differ substantially from the physical characteristics of core member 22.

In a particularly contemplated construction, peripheral layer 24 has a thickness ranging between about 0.05 and 5 millimeters and, more preferably, between about 0.1 and 2 millimeters. Although these ranges have been found to be efficacious to producing synthetic bottle closure 20 which is completely functional and achieves all of the desired goals, an exemplary embodiment for wine bottles comprises a thickness of between about 0.1 and 1 millimeter.

In producing peripheral layer 24 and achieving the desired tough, score and mar-resistant surface for core member 22, peripheral layer 24 may comprise a density ranging between about 300 $kg/m^3$ to 1,500 $kg/m^3$. In particularly contemplated embodiments, it has been found that the density of peripheral layer 24 ranges between about 750 $kg/m^3$ to 1100 $kg/m^3$.

In accordance with the present disclosure, the synthetic bottle closure 20 of the present disclosure should be formed with peripheral layer 24 intimately bonded to substantially the entire surface 26 of core member 22. If any large unbonded areas exist, flow paths for gas and liquid could result. Consequently, secure, intimate, bonded interengagement of peripheral layer 24 with core member 22 is required for attaining a bottle closure for the wine industry.

In order to achieve this integral bonded interconnection between peripheral layer 24 and core member 22, peripheral layer 24 is formed about core member 22 in a manner which assures intimate bonded engagement. The desired secure, intimate, bonded, interengagement may be attained by simultaneous co-extrusion of core member 22 and peripheral layer 24 or by applying peripheral layer 24 to core member 22 after core member 22 has been formed. By employing either process, intimate bonded interengagement of peripheral layer 24 to core member 22 is attained.

By using equipment well known in this industry, the synthetic bottle closure 20 of the present disclosure can be produced by co-extruding core member 22 simultaneously with peripheral layer 24 to provide a final product wherein peripheral layer 24 is intimately bonded to core member 22 in a single, continuous operation. If co-extrusion process is employed, once the continuous elongated co-extruded layers forming synthetic bottle closure 20 have been completely formed and are ready for final processing, the elongated dual component material produced is cut to the precise length desired for forming synthetic bottle closures 20.

After each bottle closure 20 has been formed with the desired length, the desired chamfer, if needed, is formed at each end of peripheral layer 24 in order to provide the benefits detailed above. Once the chamfer or radius has been achieved, synthetic bottle closure 20 is ready for distribution to the desired consumer, unless appropriate coatings and/or printing will be applied. Closure 20 may be coated with a suitable lubricant (e.g. silicone coating) before distribution to the desired consumer.

In the alternate construction, core member 22 is formed as an elongated, continuous, extruded foam product and is cooled or allowed to cool until ready for subsequent processing. Then, whenever desired, the continuous elongated length forming core member 22 is fed through a cross-head machine which enables peripheral layer 24 to be formed and positioned in the desired location peripherally surrounding core member 22 in intimate bonded interengagement therewith. Once the dual component product has been completed, the elongated length of material is cut to the desired length for forming bottle closure 20, as detailed above, with the desired chamfer or radius being formed in peripheral layer 24, attaining the final product.

In a further alternate embodiment, synthetic bottle closure 20 of the present disclosure is formed by employing generally conventional injection molding techniques. As is well known, injection molding is a manufacturing process where plastic is forced into a mold cavity under pressure. The mold cavity is essentially a negative of the part being produced, and the cavity is filled with plastic, and the plastic changes phase to a solid, resulting in a positive. Typically, injection pressures range from 5,000 to 20,000 psi. Because of the high pressures involved, the mold must be clamped shut during injection and cooling.

By employing this process, a plurality of separate and independent bottle closures 20 can be simultaneously formed in a multi-cavity mold having the precisely desired shape and configuration. Consequently, if beveled or chamfered edges are desired, the desired configuration is incorporated into the mold, thereby producing a product with the final shaped desired.

Typically, injection molding is employed to produce products having a single composition. However, if desired core member 22 may be formed with outer peripheral layer 24 surrounding and intimately bonded thereto using alternate techniques such as multi-step molding and multi-component molds, or subsequent coating operations, such as spray coating, tumble coating, or immersion coating. By employing these procedures, synthetic bottle closures 20 of the present disclosure are formed in an injection molding process, as desired, achieving the unique synthetic bottle closure of the present disclosure.

As discussed above, intimate bonded interengagement of peripheral layer 24 to core member 22 is required for providing a synthetic bottle closure 20 capable of being used in the wine industry. In this regard, although it has been found that the processes detailed above provide secure intimate bonded interengagement of peripheral layer 24 to core member 22, alternate layers or bonding chemicals can be employed, depending upon the particular materials used for forming core member 22 and peripheral layer 24.

If desired, well known bonding agents or tie layers can be employed on the outer surface of core member 22 in order to provide secure intimate bonded interengagement of peripheral layer 24 therewith. If a tie layer is employed, the tie layer would effectively be interposed between core member 22 and peripheral layer 24 to provide intimate bonded interengagement by effectively bonding peripheral layer 24 and core member 22 to the intermediately positioned tie layer. However, regardless of which process or bonding procedure is employed, all of these alternate embodiments are within the scope of the present disclosure.

As detailed above, a wide variety of plastic materials can be employed to produce the extruded synthetic bottle closure 20 of the present disclosure. Although each of the plastic materials detailed herein can be employed for both core member 22 and peripheral layer 24, an exemplary plastic material for forming both core member 22 and peripheral layer 24 comprises one or more selected from the group consisting of medium density polyethylenes, low density polyethylenes, metallocene catalyst polyethylenes, polypropylenes, polyesters, ethylene-butyl-acrylate copolymers, vinyl-acetate copolymers, ethylene-methyl acrylate copolymers, styrene block copolymers, olefin block copolymers, and blends of these compounds.

It has also been discovered that the outer peripheral layer or skin layer 24 may comprise a thermoplastic composition which differs from the thermoplastic composition employed for the core member. In this regard, the outer peripheral layer 24 may comprise one or more selected from the group consisting of foamable or non-foamable thermoplastic polyurethanes, thermoplastic olefins, styrene block copolymers, olefin block copolymers, thermoplastic vulcanizates, flexible polyolefins, fluoroelastomers, fluoro-polymers, polyethylenes, Teflons, and blends thereof. In addition, peripheral layer 24 may be formed from thermoplastic olefinic elastomers such as petrothene TPOE, thermoplastic urethanes, thermoplastic polyesters, and other similar product formulas.

The particular composition employed for peripheral layer 24 is selected to withstand the compression forces imposed thereon by the jaws of the corking machine. However, many different polymers, as detailed above, are able to withstand these forces and, as a result, can be employed for peripheral layer 24.

In order to form synthetic bottle closure 20 with all of the desirable inherent physical and chemical properties detailed above, one compound that has been found to be most advantageous to employ for outer peripheral layer 24 is metallocene catalyst polyethylene. As detailed below, outer peripheral layer 24 may comprise 100% metallocene catalyst polyethylene or, if desired, the metallocene catalyst polyethylene may be intermixed with a polyethylene. In this regard, it has been found that outer peripheral layer 24 may comprise between about 25% and 100% by weight based upon the weight of the entire composition of one or more polyethylenes selected from the group consisting of medium density polyethylenes, medium low density polyethylenes, and low density polyethylenes.

A formulation which has been found to be highly effective in providing an outer peripheral layer 24 is metallocene catalyst polyethylene.

Another formulation which has been found to be highly effective in providing an outer peripheral layer 24 is a thermoplastic vulcanizate.

Another formulation which has been found to be highly effective in providing an outer peripheral layer 24 which meets all of the required physical and chemical attributes to attain a commercially viable synthetic bottle closure 20 is a polyether-type thermoplastic polyurethane and/or olefin block copolymer or blends thereof.

By employing this material and forming the material in peripheral, surrounding, bonded engagement with any desired foamed core member 22, a highly effective, multilayer synthetic closure is attained which is able to meet and exceed all requirements for a wine bottle closure.

In the construction of this embodiment, the particular polyether-type thermoplastic polyurethane employed for forming outer peripheral layer 24 comprises Elastollan® LP9162, manufactured by BASF Corporation of Wyandotte, Mich. (US). As detailed below in the test data provided, this compound has been found to produce an outer layer in combination with core member 22 which provides all of the physical and chemical characteristics required for attaining a highly effective synthetic closure 20 for the wine industry.

In another embodiment of the present disclosure, the outer peripheral layer comprises thermoplastic vulcanizates (TPV). Such thermoplastic vulcanizates are well known in the art and are commercially available, for example, under the tradename Santoprene® from ExxonMobil Chemical Company of Houston, Tex. (US), Sarlink® and Uniprene® from Teknor Apex Company (US) or OnFlex® from PolyOne Inc. of Avon Lake, Ohio (US).

In addition to employing the polyether-type thermoplastic polyurethane detailed above, another compound that has been found to be highly effective in providing all of the desirable attributes required for outer peripheral layer 24 is a blend of thermoplastic olefins and thermoplastic vulcanizates. In an exemplary embodiment, the blend of thermoplastic olefins and thermoplastic vulcanizates comprises between about 100% and 90% by weight based upon the weight of the entire composition of the thermoplastic olefin and between about 100% and 90% by weight based upon the weight of the entire composition of the thermoplastic vulcanizate. As detailed below in the test data, the construction of synthetic closure 20 using an outer peripheral surface 24 formed from this blend provides a wine bottle closure which exceeds all requirements imposed thereon.

Another compound that has also been found to provide a highly effective outer peripheral layer 24 for synthetic closure 20 of the present disclosure comprises flexible polyolefins manufactured by Huntsman Corporation of Salt Lake City, Utah. These compounds are sold under the trademark REXflex FPO, and comprise homogeneous reactor-synthesized polymers, produced under proprietary technology which attains polymers having unique combinations of properties.

In a further alternate embodiment, a highly effective synthetic bottle closure 20 is attained by employing metallocene catalyst polyethylenes and/or olefin block copolymers, either independently or in combination with one selected from the group consisting of low density polyethylenes, medium density polyethylenes, and medium low density polyethylenes. In this embodiment, these materials may be employed for both core member 22 and peripheral layer 24.

Still further additional compounds which have been found to provide highly effective outer peripheral surfaces 24 for forming synthetic bottle closures 20, in accordance with the present disclosure, comprise teflon, fluoroelastomeric compounds and fluoropolymers. These compounds, whether employed individually or in combination with each other or with the other compounds detailed above have been found to be highly effective in producing an outer peripheral layer 24 which is capable of satisfying all of the inherent requirements for synthetic bottle closure 20.

Any of the compounds detailed herein for providing outer peripheral layer 24 can be employed using the extrusion processes detailed above to produce an outer layer which is securely and integrally bonded to core member 22, either as a foamed outer layer or a non-foamed outer layer. In addition, these compounds may also be employed using the molding processes detailed above to produce the desired synthetic bottle closure 20 of the present disclosure.

In addition, it has also been found that additives may be incorporated into outer peripheral layer 24 in order to further enhance the performance of the resulting synthetic bottle closure 20. As detailed above, these additional additives include slip resistant additives, lubricating agents, and sealing compounds.

It has also been discovered that further additional additives may be incorporated into either core member 22 and/or outer layer 24 of synthetic closure 20 in order to provide further enhancements and desirable performance characteristics. These additional additives incorporate antimicrobial agents, antibacterial compounds, and or oxygen scavenging materials. Suitable oxygen scavenging additives include, for example, sodium ascorbate, sodium sulfite, edetate dipotassium (dipotassium EDTA), hydroquinone, and similar substances are used to actively bind free oxygen. Oxygen scavenging additives are known in the art and are commercially available, for example, under the tradename Shelfplus O2® from Ciba AG at Basel (CH).

The antimicrobial and antibacterial additives can be incorporated into the present disclosure to impart an additional degree of confidence that in the presence of a liquid the potential for microbial or bacterial growth is extremely remote. These additives have a long-term time release ability and further increase the shelf life without further treatments by those involved with the bottling of wine. This technology has been shown to produce short as well as long term results (microbial and bacterial kills in as little as ten minutes with the long term effectiveness lasting for tens of years) which cannot be achieved with a natural product.

By employing any desired combination of these agents or additives, a further enhanced synthetic closure is realized which is capable of providing a product performance which has heretofore been incapable of being provided by either cork closures or conventional synthetic closures.

In order to attain the desired chemical and physical properties for the synthetic closure 20, core member 22 can comprise between about 0% and 75% by weight of metallocene catalyst polyethylene, and between about 25% and 100% by weight of one or more polyethylenes as detailed above. In forming peripheral layer 24 in secure, bonded interengagement therewith, it has been found that any of the formulations detailed above may be employed, with the selected formulations being affixed to core member 22 by co-extrusion or cross-head extrusion methods.

As described hereinbefore, the method of applying indicia 29 on at least one of the two substantially flat terminating surfaces 27, 28 of the closure 20 comprises the following steps:

A. providing a stamping foil 50 comprising at least a carrier film and a decorative layer;

B. providing a stamping tool 40 that is patterned so as to form a negative image of indicia 29 by raised regions 45 on the surface of stamping tool 40;

C. placing stamping foil 50 on top of or slightly above said terminating surface 27 of closure 20 with said decorative layer facing towards flat terminating surface 27, whereby flat terminating surface 27 is at least partially covered by stamping foil 50;

D. pressing stamping foil 50 against terminating surface 27 of closure 20 by means of stamping tool 40 under application of heat and/or pressure, whereby those portions of the decorative layer that have been in contact with raised regions 45 of stamping tool 40 are being transferred from the stamping foil 50 and permanently affixed to terminating surface 27 of closure 20, thereby forming the desired indicia 29 on terminating surface 27 of closure 20; and E. removing the used stamping foil 50, thereby uncovering indicia 29 formed on terminating surface 27 of closure 20.

Figure 3:
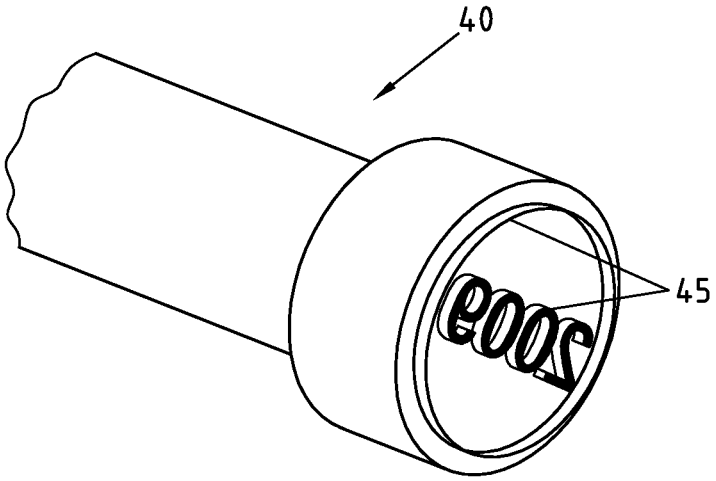
FIG. 3 is a perspective view of a stamping tool suitable for use in the method according to the present disclosure.

In FIG. 3 a hot stamping tool 40 for pressing the stamping foil 50 against the terminating surface 27 of the closure 20 is depicted. The hot stamping tool 40 has raised regions 45 forming a negative image of the numbers "2009" and a circle. The hot stamping tool 40 may be made of metal and is connected to a heating unit (not depicted) and/or pressure unit (not depicted) so as to allow the hot stamping tool 40 to be heated to a desired temperature and/or applied to the terminating surface 27 of the closure 20 with the desired pressure.

Figure 4:
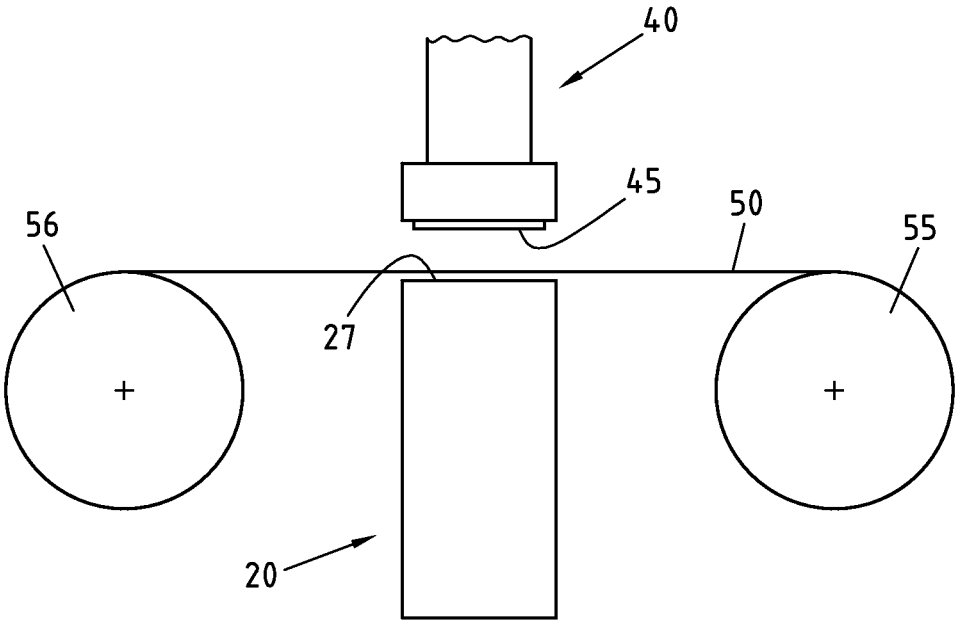
FIG. 4 is a cross-sectional side elevation of a synthetic closure, a stamping foil and a stamping tool suitable for use in the method according to the present disclosure.

FIG. 4 is a schematic representation of a suitable assembly for carrying out the method according to the present disclosure. A stamping foil 50 is arranged in a position between terminating surface 27 of closure 20 and stamping tool 40, the raised portion 45 of stamping tool 40 facing in the direction of the upper surface of the stamping foil 50. The stamping foil 50 comprises at least a carrier film (not depicted) and a decorative layer 29, the decorative layer 29 of stamping foil 50 facing towards the terminating surface 27 of the closure 20. In addition to the carrier film and the decorative layer 29 the stamping foil 50 may contain further layers. In order to allow an faster throughput of the method according to the disclosure, the stamping foil 50 is movably arranged between terminating surface 27 of closure 20 and stamping tool 40 and the used stamping foil 50 can be rolled on roll 55, whereby unused stamping foil 50 is rolled off supply roll 56 for stamping of the subsequent closure 20. The raised portion 45 of stamping tool 40 is pressed against terminating surface 27 of closure 20, whereby the area of the decorative layer 29 of stamping foil 50 that has been in contact with the raised regions 45 stamping tool 40 are transferred from stamping foil 50 and permanently affixed to terminating surface 27 of closure 20, thereby forming the numbers "2009" and a circle 29 on terminating surface 27 of closure 20. Once the transfer has been completed, the used stamping foil 50 is removed from the closure, if necessary, and rolled on roll 55.

In order to demonstrate the efficacy of the present disclosure, samples of synthetic bottle closures 20, manufactured in accordance with the present disclosure and having a foamed core member and a solid peripheral layer were produced and tested. These sample products were produced on conventional co-extrusion equipment. Core member 22 was produced by employing low density polyethylene (LDPE) using an inert gas as physical blowing agent. The degree of foaming was adjusted so as to produce samples having a density of approximately 240 kg/m$^3$. In forming peripheral layer 24, a mixture of EPDM and PP and metallocene PE was employed. In the forming process, peripheral layer 24 was foamed in the extrusion equipment peripherally surrounding core member 22 and being intimately bonded thereto. The resulting products were cut in lengths suitable for forming bottle closure 20. The resulting closures had a diameter of 22.5 mm and a length of 44 mm.

The sample closures were subjected to hot stamping as described in the preceding paragraph, thereby transferring the letters "2009" and a circle 29 to terminating surface 27 of closure 20. Hot stamping was effected at a temperature of approximately 120 degrees Celsius using a stamping foil 50 whose decorative layer 29 contained the following portions: (a) an adhesive layer portion having a thickness of about 0.5 to about 5 microns in one embodiment and a thickness of about 0.5 to about 20 microns in another embodiment, (b) a pigmented or colored lacquer layer portion having a thickness of about 1 to about 10 microns in one embodiment and a thickness of about 1 to about 15 microns in another embodiment, and (c) a transparent protective lacquer layer portion having a thickness of about 1 to about 10 microns in one embodiment and a thickness of about 1 to about 15 microns in another embodiment, with the adhesive layer portion (a) facing directly towards terminating surface 27 of closure 20, portion (b) being arranged on top of portion (a) and being in close interconnection therewith, and portion (c) being arranged on top of portion (b) and being in close interconnection therewith. The adhesive layer portion of the decorative layer 29 contained an adhesive having an activation temperature of approximately 110 to 115 degrees Celsius. All materials of the decorative layer 29, in particular the materials of protective layer portion (c) were compliant or approved as food contact substances (FCS) by the U.S. Food and Drug Administration (FDA) or the European Union (EU).

Testing of the sample closures showed that the decorative layer 29 is securely affixed and completely bonded to surface 27 of closure 20. Moreover, contrary to previous expectations, the application of a decorative layer 29 on terminating surface 27 in accordance with the method of the disclosure does not significantly alter the gas permeation and mechanical properties of the closure.

It will thus be seen that the objects set forth above, among those made apparent from the preceding description, are efficiently obtained and, since certain changes may be made in carrying out the above method without departing from the scope of this disclosure, it is intended that all matter contained in the above description or shown in the accompanying drawings shall be interpreted as illustrative and not in a limiting sense. Furthermore, it should be understood that the details of the disclosure described in the foregoing detailed description are not limited to the specific embodiments shown in the drawings but are rather meant to apply to the disclosure in general as outlined in the summary and in the claims.

It is also to be understood that the following claims are intended to cover all of the generic and specific features of the disclosure herein described, and all statements of the scope of the disclosure which, as a matter of language, might be said to fall there between.

Having described our invention, what we claim as new and desire to secure by Letters Patent is:

1. A closure for a product retaining container constructed for being inserted and securely retained in a portal forming neck of the container with the closure being in direct fluid communication with a fluid product within the product retaining container, the closure comprising:

a substantially cylindrical shape comprising a length;

substantially flat terminating surfaces forming opposed ends of said closure and defining a gas permeation property of the closure corresponding to a gas permeation rate through the opposed ends of the closure when the closure is disposed in the portal forming neck of the container; and a decorative layer only partially covering at least one of said terminating surfaces such that the gas permeation property of the closure is not significantly altered by presence of the decorative layer, the decorative layer comprising a plastic material and being compositionally different from a material of said terminating surfaces;

wherein in use the entire length of the closure fits into the portal forming neck of the container without the closure extending beyond a lateral width of the portal forming neck of the container.

2. The closure of claim 1, wherein said decorative layer is applied to said terminating surfaces by means of heat transfer, pressure transfer and/or hot stamping.

3. The closure of claim 1, wherein said decorative layer comprises a first color;

wherein said terminating surfaces comprise a second color; and wherein the first color differs from the second color.

4. The closure of claim 1, wherein said decorative layer comprises at least one plastic film.

5. The closure of claim 1, wherein said decorative layer comprises a polyester.

6. The closure of claim 1, wherein said decorative layer comprises a pigment or dye.

7. The closure of claim 1, further comprising a hot melt adhesive affixing said decorative layer to said at least one of said terminating surfaces.

8. The closure of claim 1, wherein said decorative layer comprises one or more materials that are compliant or approved as food contact substances (FCS) by the U.S. Food and Drug Administration (FDA) or the European Union (EU).

9. The closure of claim 1, wherein said decorative layer comprises a thickness of 0.5 microns to 100 microns.

10. The closure of claim 1, wherein said decorative layer forms an indicia.

11. The closure of claim 10, wherein said indicia comprises one or more indicia selected from the group consisting of letters, symbols, colors, graphics, and wood tones.

12. The closure of claim 1, wherein a surface of said decorative layer is in complete, intimate, bonded engagement with said at least one of said terminating surfaces.

13. The closure of claim 1, wherein said closure comprises a synthetic closure.

14. The closure of claim 13, wherein said closure comprises one or more thermoplastic polymers.

15. The closure of claim 1, wherein said closure comprises pieces of natural cork.

16. The closure of claim 15, wherein said pieces of natural cork are agglomerated by an adhesive or embedded in a plastic material.

17. The closure of claim 1, wherein said closure is wholly or partially formed of a foamed material.

18. The closure of claim 17, wherein a cell size and/or cell distribution in the foamed material are substantially uniform throughout an entire length and/or diameter of the foamed material.

19. The closure of claim 17, wherein the foamed material comprises a substantially closed cell foam.

20. The closure of claim 17, wherein the foamed material comprises a cell size characterized by a range of between about 0.025 mm minimum and about 0.5 mm maximum.

21. The closure of claim 1, further comprising a silicone layer positioned on at least one surface.

22. A closure for a product retaining container constructed for being inserted and securely retained in a portal forming neck of the container with the closure being in direct fluid communication with a fluid product within the product retaining container, the closure comprising:

an elongated, cylindrically shaped core member formed from foamed plastic material and comprising terminating end surfaces forming opposed ends of the cylindrically shaped core member, wherein the terminating end surfaces define a gas permeation property of the closure corresponding to a gas permeation rate through the opposed ends of the core member when the closure is disposed in the portal forming neck of the container;

a decorative layer only partially covering at least one terminating end surface such that the gas permeation property of the closure is not significantly altered by presence of the decorative layer, the decorative layer comprising a plastic material and being compositionally different from a material of the at least one terminating end surface; and at least one peripheral layer peripherally surrounding and intimately bonded to the cylindrically shaped core member with the at least one terminating end surface of the core member being devoid of said at least one peripheral layer;

wherein the closure comprises a length, and in use the entire length of the closure fits into the portal forming neck of the container without the closure extending beyond a lateral width of the portal forming neck of the container; and wherein the closure is adapted to seal the fluid product in the container for a desired length of time without substantially any degradation of the product or degradation of the closure.

23. The closure of claim 22, wherein the core member comprises at least one thermoplastic polymer selected from the group consisting of polyethylenes, metallocene catalyst polyethylenes, polybutanes, polybutylenes, polyurethanes, silicones, vinyl-based resins, thermoplastic elastomers, polyesters, ethylenic acrylic copolymers, ethylene-vinyl-acetate copolymers, ethylene-methyl-acrylate copolymers, thermoplastic polyurethanes, thermoplastic olefins, thermoplastic vulcanizates, flexible polyolefins, fluorelastomers, fluoropolymers, polyethylenes, polytetrafluoroethylenes, and blends thereof, ethylene-butyl-acrylate copolymers, ethylene-propylene-rubber, styrene butadiene rubber, styrene butadiene block copolymers, ethylene-ethyl-acrylic copolymers, ionomers, polypropylenes, and copolymers of polypropylene and copolymerizable ethylenically unsaturated comonomers, olefin block copolymers and mixtures thereof.

24. The closure of claim 22, wherein said core member comprises a density ranging between about 100 kg/m$^3$ to about 500 kg/m$^3$.

25. The closure of claim 22, wherein said core member comprises a density ranging between about 200 kg/m$^3$ to about 350 kg/m$^3$.

26. The closure of claim 22, wherein said core member comprises closed cells having an average cell size ranging from between about 0.02 mm to about 0.50 mm and/or a cell density ranging between about 8,000 cells/cm$^3$ to about 25,000,000 cells/cm$^3$.

27. The closure of claim 26, wherein said core member comprises an average cell size ranging between about 0.05 mm and 0.1 mm and/or a cell density ranging between about 1,000,000 cells/cm$^3$ to about 8,000,000 cells/cm$^3$.

28. The closure of claim 22, wherein said at least one peripheral layer is selected from the group consisting of foamed plastics and non-foamed plastics.

29. The closure of claim 22, wherein said at least one peripheral layer is selected from the group consisting of foamable or non-foamable thermoplastic polyurethanes, thermoplastic olefins, thermoplastic vulcanizates, EPDM rubber, flexible polyolefins, fluoroelastomers, fluoropolymers, polyethylenes, polytetrafluoroethylenes, olefin block copolymers, and blends thereof.

30. The closure of claim 22, wherein said at least one peripheral layer comprises a thickness ranging between about 0.05 mm and about 5 mm.

31. The closure of claim 22, wherein said at least one peripheral layer comprises a thickness ranging between about 0.1 mm and about 2 mm.

32. The closure of claim 22, wherein said at least one peripheral layer comprises a tough, score and mar resistant surface and/or a density ranging between about 300 kg/m$^3$ and 1,500 kg/m$^3$.

33. The closure of claim 22, wherein said at least one peripheral layer comprises a density between about 750 kg/m$^3$ and about 1100 kg/m$^3$.

34. The closure of claim 22, wherein said closure is further defined as being formed by extrusion and/or injection molding.

35. The closure of claim 22, wherein said core member comprises an extruded core member.

36. The closure of claim 22, wherein said core member and said at least one peripheral layer are further defined as being extruded simultaneously.

37. The closure of claim 22, wherein said core member is further defined as being extruded separately and subsequent thereto said at least one peripheral layer is formed in extrusion equipment peripherally surrounding and enveloping the core member.

* * * * *